US006167805B1

(12) United States Patent
Williams et al.

(10) Patent No.: US 6,167,805 B1
(45) Date of Patent: Jan. 2, 2001

(54) MANDREL CARRIER FOR HIGH SPEED CAN DECORATORS

(75) Inventors: Robert Williams, Randolph; Chester Chrobocinski, Carteret, both of NJ (US)

(73) Assignee: Sequa Corporation, Hackensack, NJ (US)

( * ) Notice: Under 35 U.S.C. 154(b), the term of this patent shall be extended for 0 days.

(21) Appl. No.: 09/248,247

(22) Filed: Feb. 10, 1999

(51) Int. Cl.[7] ..... B41F 17/22
(52) U.S. Cl. ..... 101/40; 101/38.1
(58) Field of Search ..... 101/35, 38.1, 39, 101/40, 40.1

(56) References Cited

U.S. PATENT DOCUMENTS 3,766,851 10/1973 Sirvet et al. .
4,140,053 2/1979 Skrypek et al. .
4,821,638 4/1989 Uithoven .
5,111,742 5/1992 DiDonato et al. .
5,799,574 9/1998 Williams et al. .

*Primary Examiner*—Ren Yan
(74) *Attorney, Agent, or Firm*—Mitchell D. Bittman; Jerome Berliner; Robert Faber

(57) ABSTRACT

A continuous motion can decorator includes a plurality of mandrel subassemblies mounted on a rotating carrier with equal angular spacings between adjacent subassemblies. The assemblies reciprocate radially with respect to the carrier axis as a center. Each subassembly includes a radially extending support arm that mounts a radially extending mono rail which extends through guide bearing units on the carrier. The mandrel of each subassembly is mounted on an axis that is parallel to the rotational axis of the carrier. An eccentric type mounting is provided for the mandrel axle on the reciprocating arm so that there is an individually operated means to adjust spacing between the carrier rotational axis and the mandrel axis. Vacuum and pressurized air are fed selectively to each mandrel subassembly through a flexible hose having a single loop that is formed by curving virtually the entire length of the hose.

14 Claims, 10 Drawing Sheets

FIG. 6
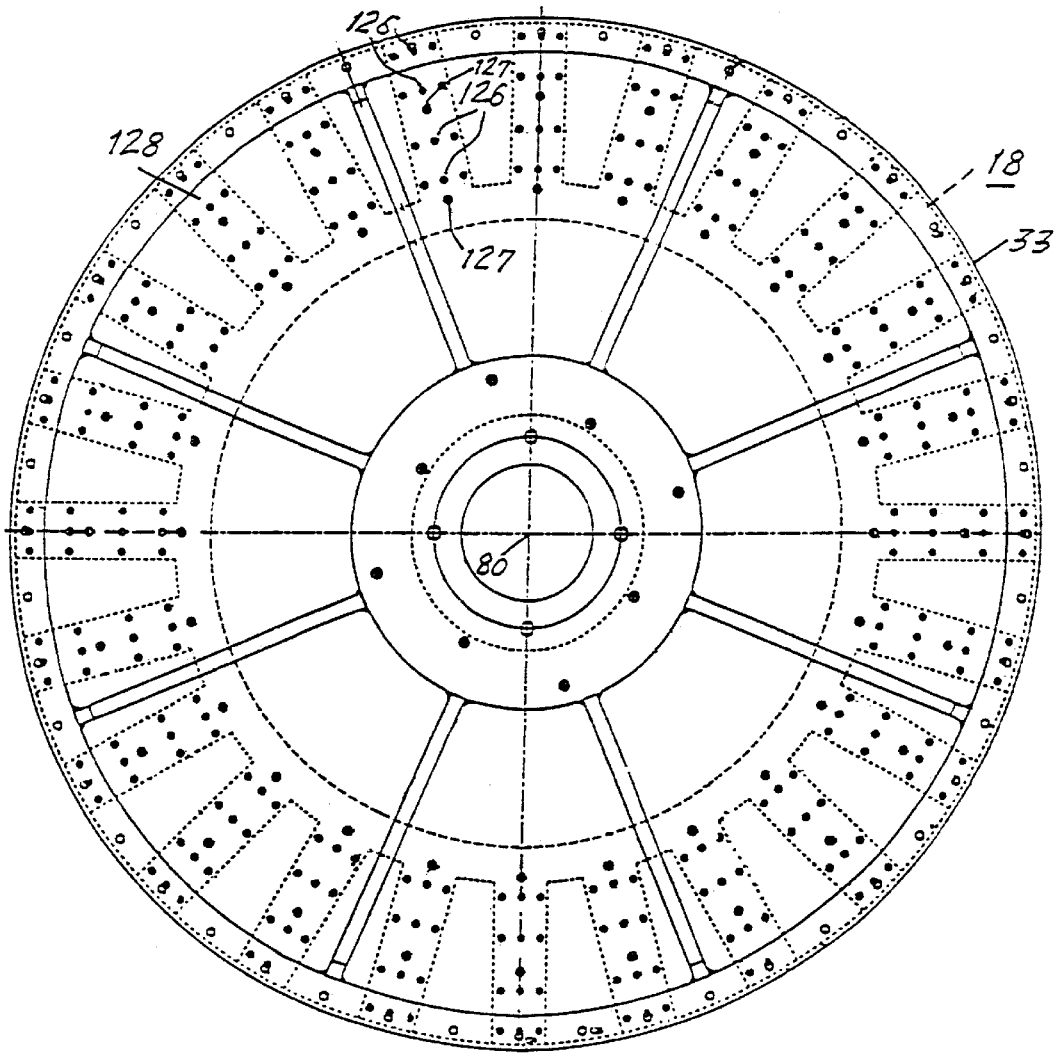
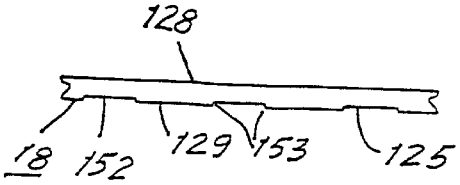
FIG. 7

FIG. 16
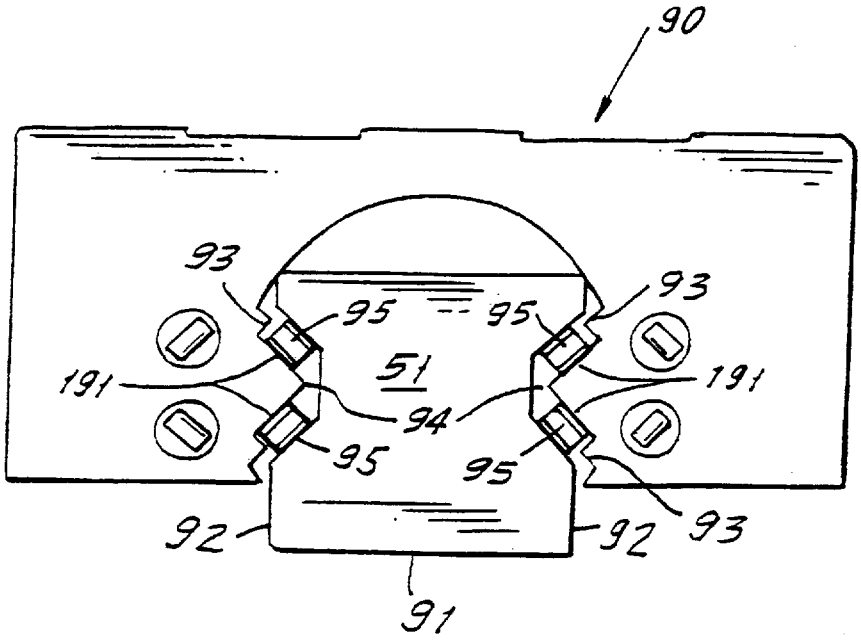
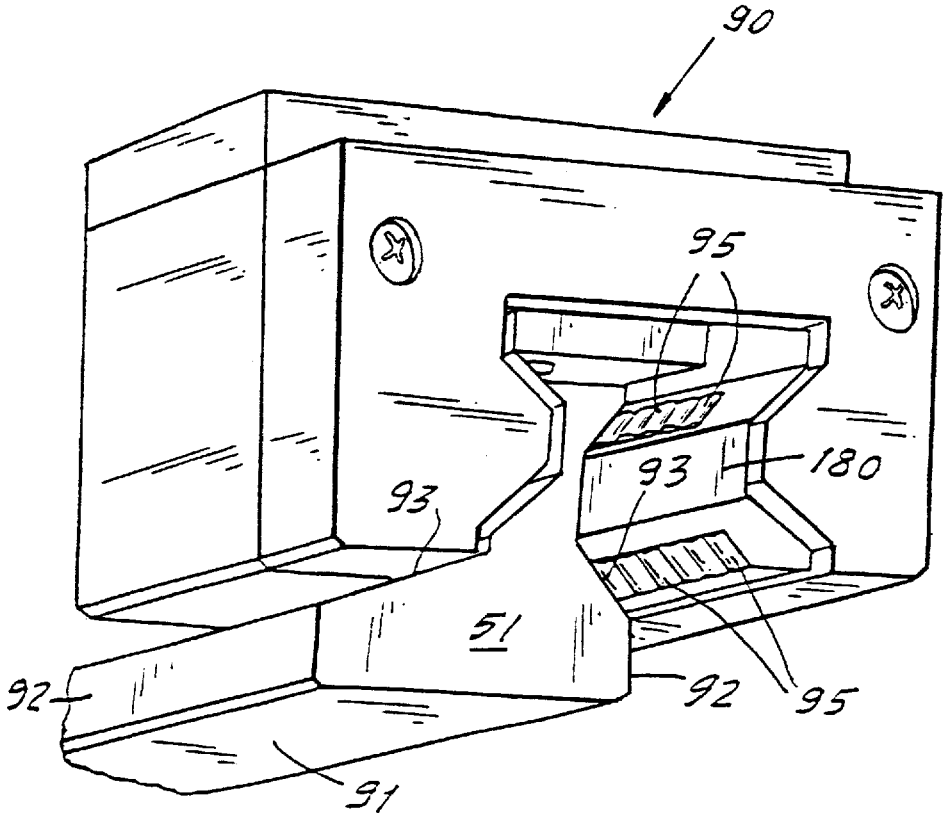
FIG. 17

MANDREL CARRIER FOR HIGH SPEED CAN DECORATORS

BACKGROUND OF THE INVENTION

This invention relates generally to continuous motion high speed apparatus for applying decorations to cylindrical containers and in particular relates to improvements in mandrel carriers for apparatus of that type which is disclosed in U.S. Pat. Nos. 4,821,638 and 5,799,574.

Incorporated herein by reference are teachings of the aforesaid U.S. Pat. No. 4,821,638 which issued Apr. 18, 1989 to P.G. Uithoven for Apparatus Supporting and Printing Cylindrical Objects and U.S. Pat. No. 5,799,574 which issued Sep. 1, 1998 to R. Williams, C. Chrobocinski and A. C. Rodums for Spindle Disc for High Speed Can Decorators. Also incorporated herein by reference are the teachings of U.S. Pat. No. 3,766,851 issued Oct. 23, 1973 to E. Sirvet et al for Continuous Can Printer and Handling Apparatus, U.S. Pat. No. 4,140,053 issued Feb. 20, 1979 to J. Skypek et al for Mandrel Mounting and Trip Mechanism for Continuous Motion Decorator and U.S. Pat. No. 5,111,742 issued May 12, 1992 to R. DiDonato et al for Mandrel Trio Subassembly for Continuous Motion Can Decorators.

U.S. Pat. No. 5,799,574 discloses relatively high speed apparatus for applying decorations to the exterior of cylindrical containers while they are mounted on mandrels which are disposed along the periphery of a large continuously rotating disc-like carrier. Decorations are applied to the containers as they engage a rotating blanket of a decorator that is adjacent the periphery of the carrier. During engagement between the containers and the blanket, the containers track the blanket surface through the printing region where the containers and blanket surface are engaged. To accomplish this tracking, for each angular position of the container measured about the axis of the spindle disc as a center, a device controlled by a closed loop or box cam maintains the container in a precise radial position relative to the axis of the spindle disc.

This type of decorating equipment includes a number of relatively heavy elements that move at high speed. Because there must be precise coordination between the various elements, inertia forces, lubrication and operating power are significant engineering design considerations, as are equipment downtime, maintenance costs and setup procedures.

SUMMARY OF THE INVENTION

In accordance with the instant invention, each of the mandrels is part of an individual mandrel subassembly that includes a support arm which must, be relatively rigid in order to properly position the cantilevered mandrel while decorations are being applied to the container carried thereby. To accomplish this, in the instant invention the arm is relatively flat and is provided with a longitudinally extending rail that rides in a linear slide which directs the subassembly to reciprocate radially with respect to the rotational axis of the mandrel carrier. Sideways deflection of the subassembly arm relative to the mandrel carrier is limited by utilizing a roller type linear slide which has multiple groups of bearing elements that engage longitudinal bearing surfaces on the rail. Each bearing surface faces in a different direction and is engaged by a different group of bearing elements. Each bearing element is cylindrical and has a rotational axes that is transverse to the reciprocation path of the rail that is engaged by such element.

Positional integrity of the subassemblies relative to the carrier is maintained by providing shallow channels in the carrier to receive the slides, and shallow grooves in the support arms to receive an individual rail. Parallel channel arms fit tightly against the housing for the slide that is entered in the channel and arms forming the groove fit tightly against side surfaces of the rail.

To simplify setup and to increase the interval between setups, the axis of the spindle is eccentric with respect to the axis of the rear mounting section of the axle having the spindle at the front thereof. The mounting section is provided with an external cylindrical surface that is engaged by a matching internal cylindrical surface of a mounting hole in the subassembly arm at the radially outer end thereof. Thus, pivoting the axle about the mounting axis causes a change in spacing between the spindle axis and the carrier axis to control contact pressure between the cans and the printing blanket. Pivoting of the axle is accomplished by two adjusting screws, each of which is on the arm and extends inward of the internal cylindrical surface of the internal cylindrical surface to engage an individual ledge formed in the external cylindrical surface. With one screw backed away from its companion ledge, inward movement of the other screw forces the axle to pivot in a first direction, and by backing the other screw away from its companion ledge, inward movement of the one screw forces the axle to pivot in a direction opposite to the first direction.

Accordingly, the primary object of the instant invention is to provide an improved high speed continuous motion cylindrical container decorator having substantially reduced maintenance and/or power requirements.

Another object is to provide a decorator of this type wherein substantial cost and weight reductions have been achieved for the disc-like carrier and reciprocating mandrel subassemblies carried thereby.

Still another object is to provide a construction for this type of decorator to simplify setup procedures, extend periods of operation and reduce downtime for maintenance.

A further object is to reduce printing pressure requirements while maintaining print quality.

A still further object is to improve positional integrity between the mandrel carrier and moving elements of the mandrel subassemblies mounted on the carrier and reciprocating radially with respect to the rotational axis of the carrier.

Yet another object is to provide elongated roller-type linear slides to mount the reciprocating mandrel subassemblies on the carrier.

These objects as well as other objects of this invention shall become readily apparent after reading the following description of the accompanying drawings in which:

BRIEF DESCRIPTION OF THE DRAWINGS

FIG. 6 is a front elevation of the assembly in FIG. 5.

FIG. 7 is a fragmentary edge view of the mandrel carrier.

FIG. 16 is a schematic end view of a mono rail engaged with the rollers of a linear slide.

FIG. 17 is a fragmentary perspective illustrating an end portion of the mono rail partially engaged with a linear slide.

DETAILED DESCRIPTION OF THE INVENTION

Figure 1:
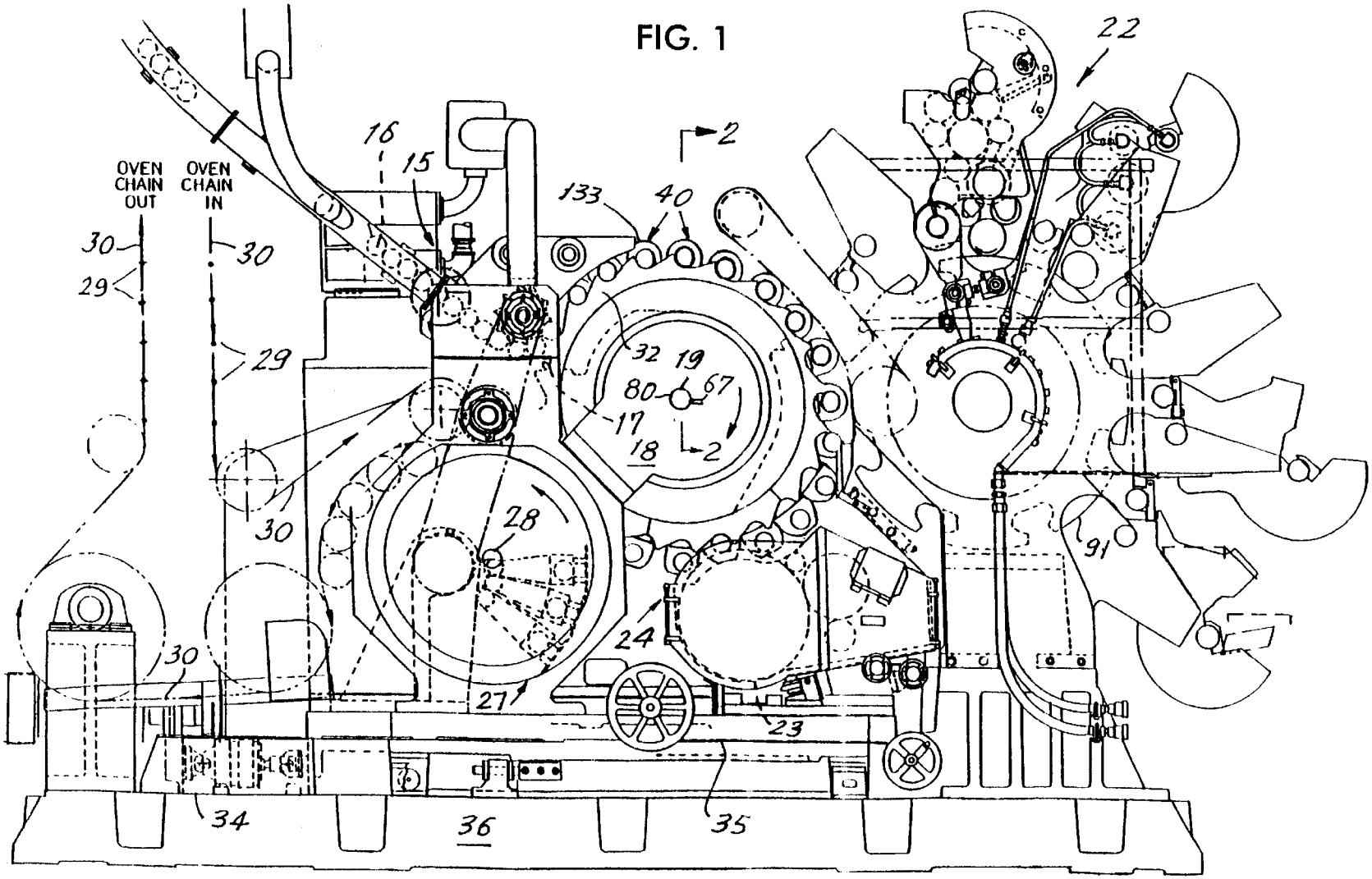
FIG. 1 is a front elevation of continuous motion can decorating apparatus that includes a mandrel carrier assembly constructed in accordance with teachings of the instant invention.
Figure 2:
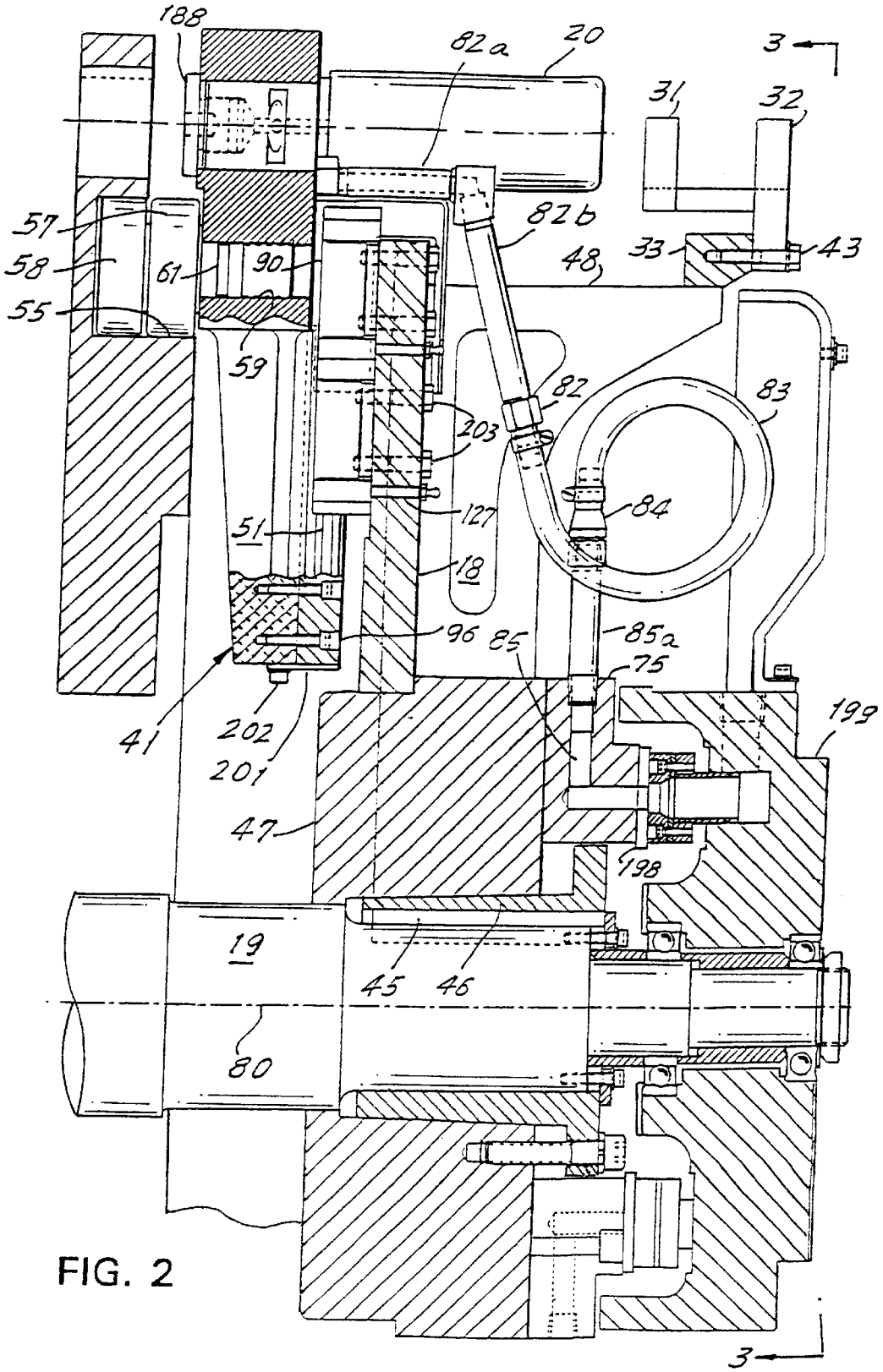
FIG. 2 is a fragmentary cross-section of the mandrel carrier assembly taken through line 2—2 of FIG. 1 looking in the direction of arrows 2—2.
Figure 3:
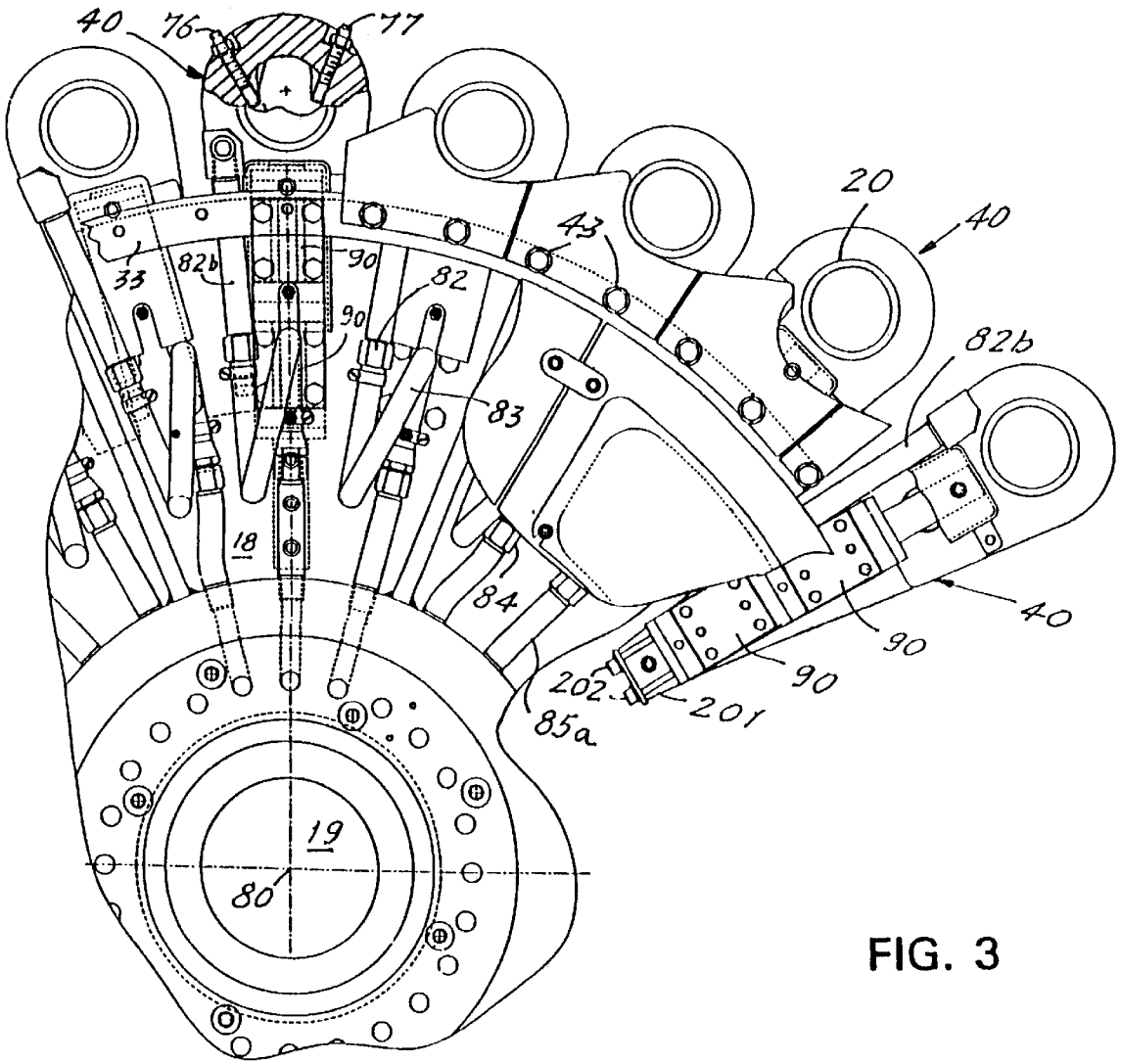
FIG. 3 is a fragmentary front elevation of the mandrel carrier assembly looking in the direction of arrows 3—3 of FIG. 2.
Figure 4:
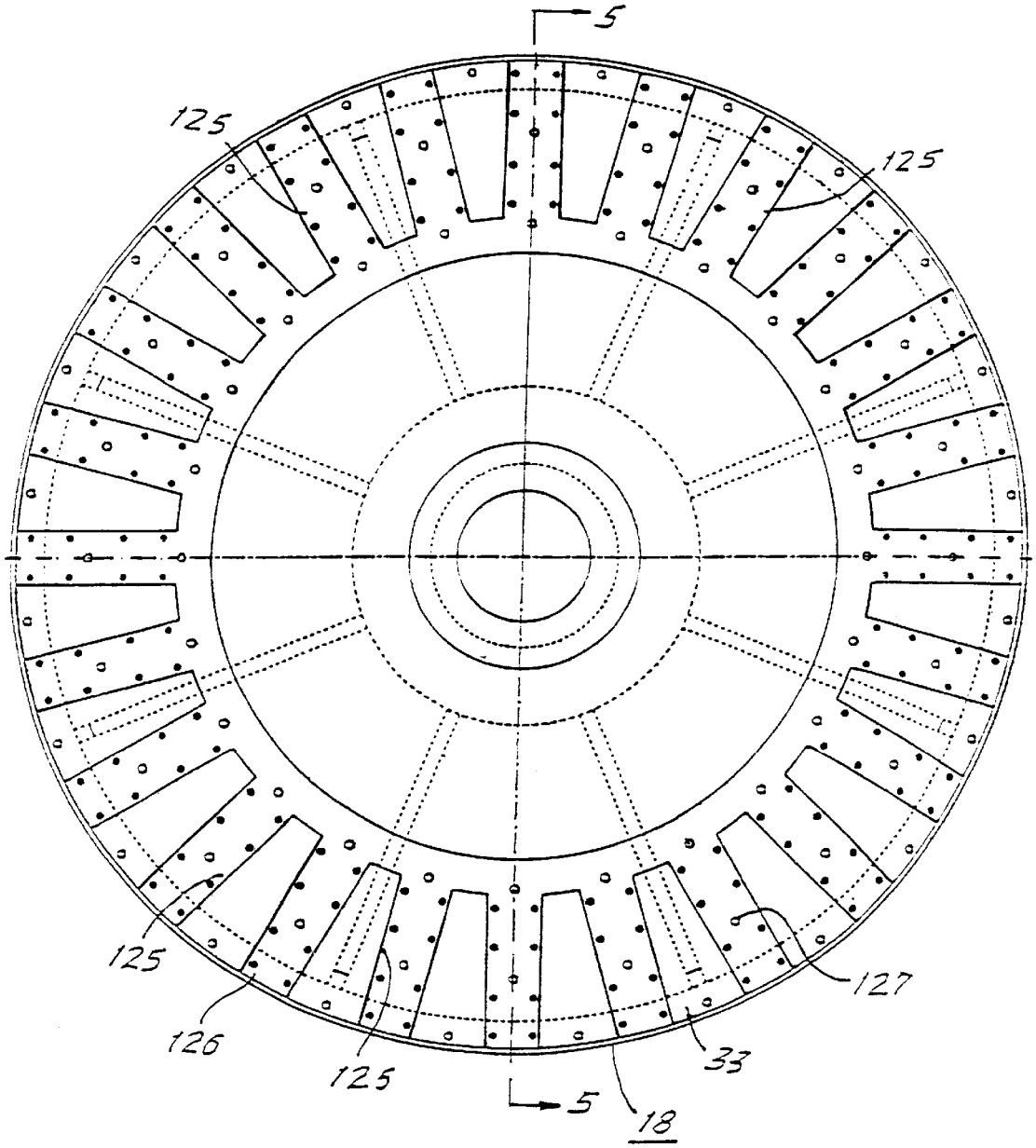
FIG. 4 is a rear elevation of the mandrel carrier and elements welded thereto.
Figure 5:
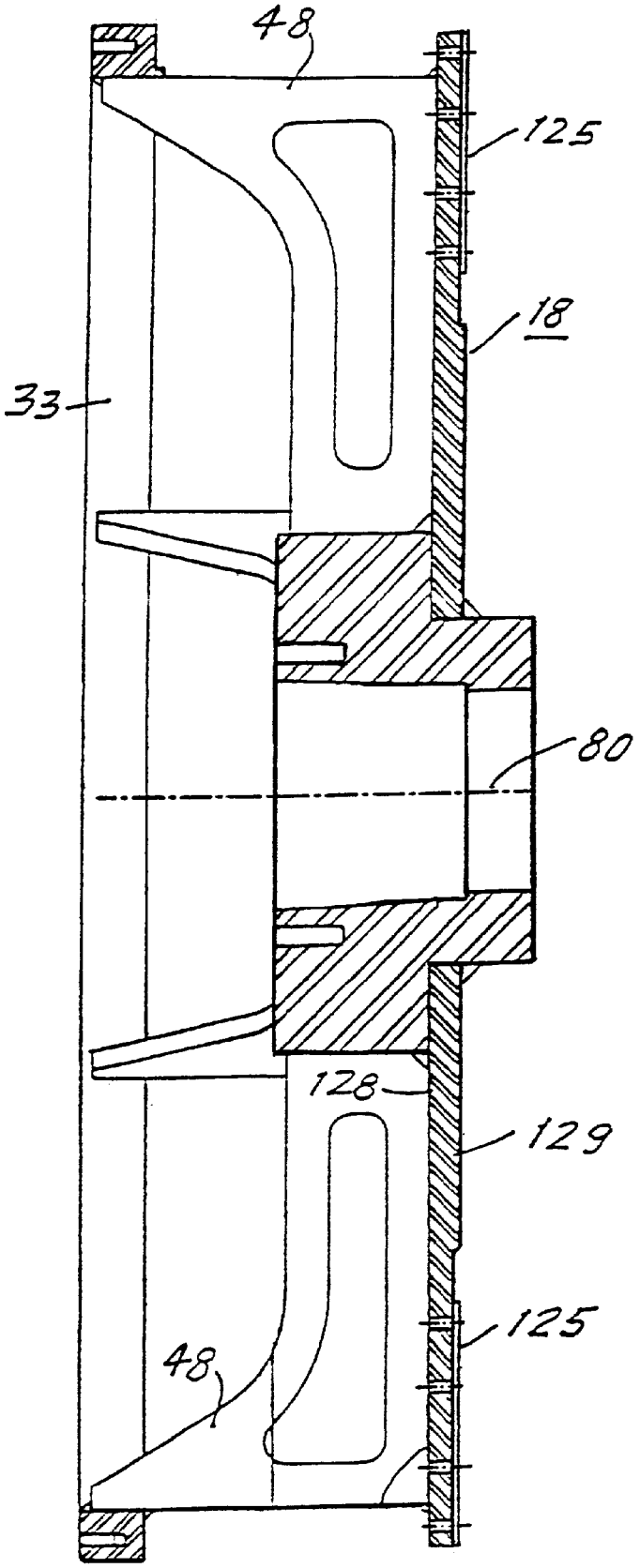
FIG. 5 is a cross-section taken through line 5—5 of FIG. 4 looking in the direction of arrows 5—5.

Now referring to the Figures and more particularly to FIG. 1 which illustrates continuous motion cylindrical container decorating apparatus of the general type described in the aforesaid U.S. Pat. Nos. 3,766,851 and 5,111,742. The apparatus of FIG. 1 includes infeed conveyor chute 15 which receives undecorated containers in the form of beverage cans 16, each open at one end thereof, from a can supply (not shown) and places cans 16 in arcuate cradles or pockets 17 formed by aligned depressions in the outer edges of spaced segmented rings 31, 32 (FIG. 2). The latter are fixedly secured to support ring 33 that is positioned in front of and secured to disc-like mandrel carrier 18 on eight angularly spaced standoffs 48. Screws 43 secure the segments of pocket rings 31, 32 to support ring 33.

Carrier 18 is mounted on continuously rotating horizontal drive shaft 19 whose first end (toward the left in FIG. 2) is rotatably supported on a fixed portion of the frame of the decorating apparatus illustrated in FIG. 1. Shaft 19 is drivingly connected to carrier 18 by key 45 that engages tapered sleeve 46 which is wedged between drive shaft 19 and hub 47. The latter is welded to carrier 18 at the center thereof.

Figure 12:
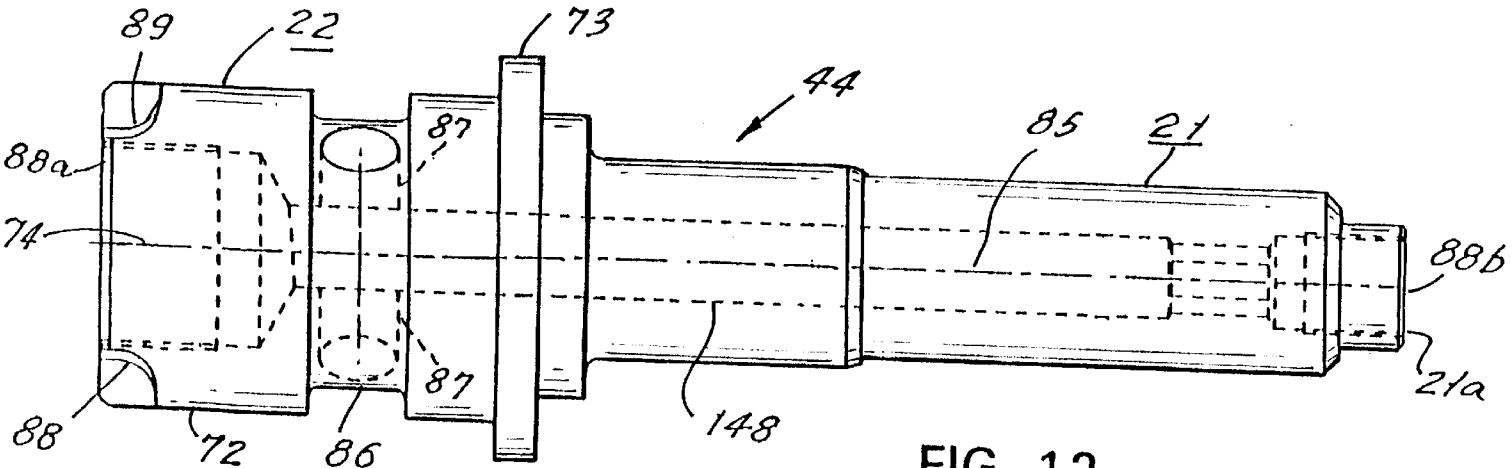
FIG. 12 is a side elevation of an axle which includes a spindle section on which a mandrel is rotatably mounted.
Figure 13:
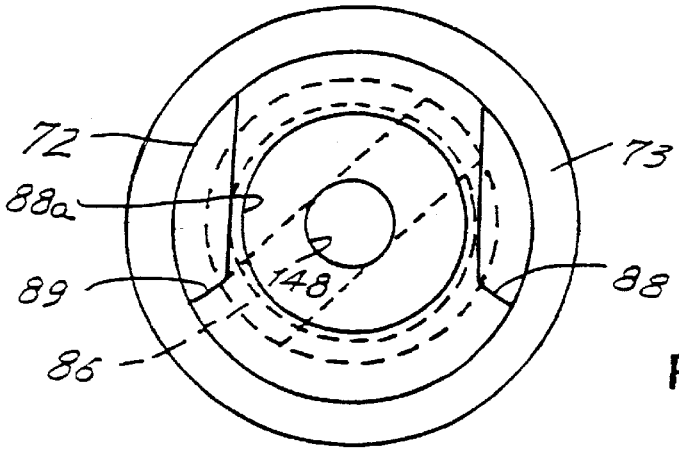
FIG. 13 is an elevation looking at the rear end of the axle in FIG. 12.
Figure 14:
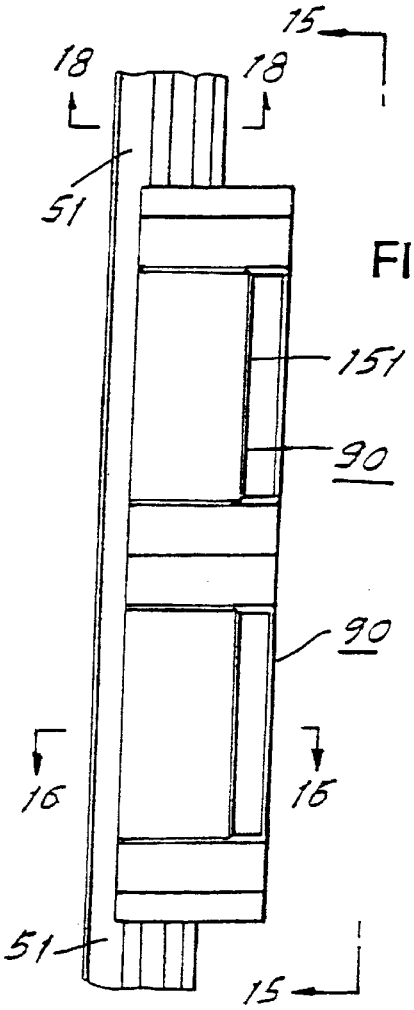
FIG. 14 is a side elevation of two elongated roller-type linear slides in operative engagement with a mono rail of a mandrel subassembly.
Figure 15:
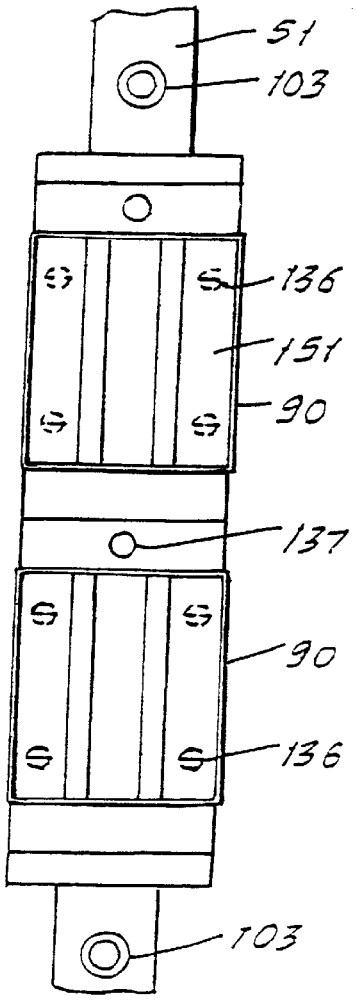
FIG. 15 is a front elevation of the elements in FIG. 14 looking in the direction of arrows 15—15 in FIG. 14.

Horizontally extending mandrels 20 (FIG. 2) are also mounted to carrier 18, with each mandrel 20 being in spaced horizontal alignment with an individual pocket 17 while passing through a short loading region extending downstream from infeed conveyor 15. In this short region, undecorated cans 16 are moved horizontally rearward by a deflector (not shown), being transferred from each cradle 17 to an individual mandrel 20. Suction applied through an axial passage 148 (FIG. 12) extending to the outboard or front end 21 a of spindle shaft 21 on which mandrel 20 rotates freely, draws container 16 rearward (to the left with respect to FIG. 2) to final seating position on mandrel 20.

While mounted on mandrels 20, cans 16 are decorated by being brought into engagement with continuously rotating image transfer mat or printing blanket 91 of the multicolored printing press decorating section indicated generally by reference numeral 22. Thereafter, and while mounted to mandrels 20, each decorated can 16 is coated with a protective film of varnish applied thereto by engagement with the periphery of applicator roll 23 in the overvarnish unit indicated generally by numeral 24. Cans 16 with decorations and protective coatings thereon are then transferred from spindles 20 to suction cups (not shown) mounted near the periphery of transfer wheel 27 while the latter rotates about shaft 28 as a center. Cans 16 carried by transfer wheel 27 are deposited on generally horizontal pins 29 which project from chain type output conveyor 30 that carries cans 16 through a curing oven (not shown).

By the time mandrel 20 moves beyond the downstream end of chute 15 and is in the proximity of sensor 133, each mandrel 20 should be properly loaded with a can 16. If sensor 133 detects that a mandrel 20 is unloaded or is not properly loaded, then before this particular mandrel 20 enters the decorating zone wherein printing blanket 91 normally engages can 16 on mandrel 20, this unloaded or misloaded mandrel 20 is moved to a tripped or "no-print" position relative to printing blanket 91. As a tripped mandrel 20 moves through the decorating zone it will be spaced from the periphery of blanket 91. This no-print position is achieved by controlling double acting cylinder 34 to trip subframe 35 having mandrel carrier shaft 19 mounted thereon, by moving subframe 35 to the left with respect to FIG. 1 while main base 36, to which printing unit 22 is mounted, remains stationary. Further, actuation of sensor 133 causes overvarnish unit 24 to move downward with respect to mandrel carrying shaft 19 so that the tripped spindles 20 do not engage overvarnish application roll 23.

Figure 8:
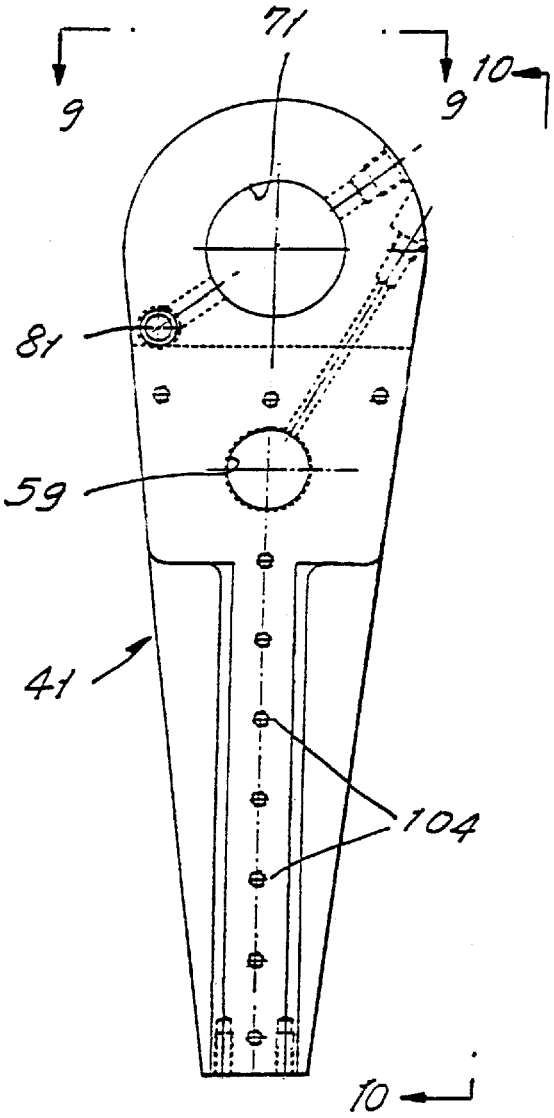
FIG. 8 is a front elevation of the support arm of a mandrel subassembly.
Figure 10:
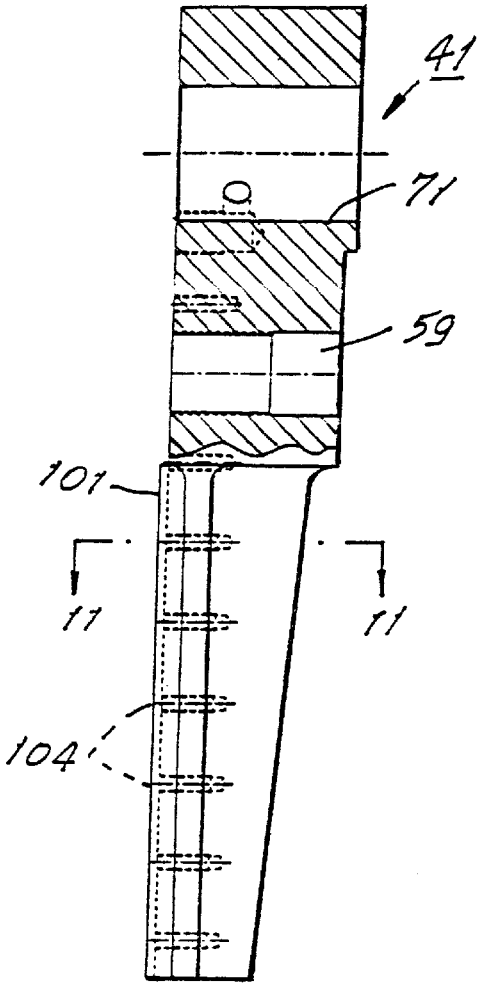
FIG. 10 is a side elevation, partially sectioned, of the support arm looking in the direction of arrows 10—10 in FIG. 8.
Figure 11:
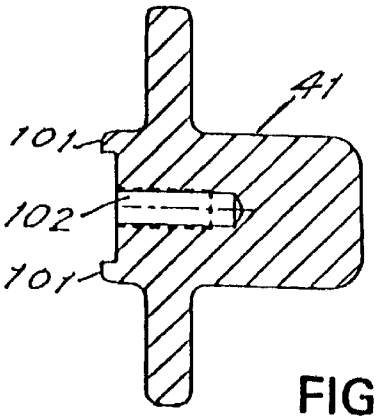
FIG. 11 is a cross-section taken through line 11—11 in FIG. 10 looking in the direction of arrows 11—11.
Figure 9:
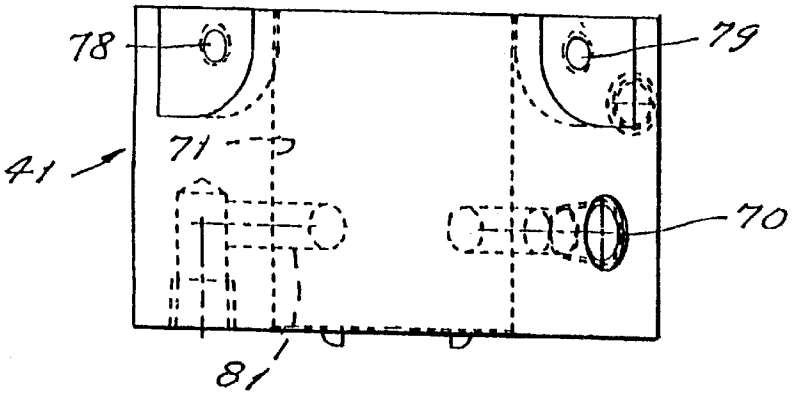
FIG. 9 is an elevation looking in the direction of arrows 9—9 in FIG. 8 at the radially outer end of the support arm.

Mandrel 20 is part of mandrel subassembly 40 that also includes support arm or base 41 (FIG. 8), shaft 44 (FIG. 12), rigid straight rail 51 and two cam follower rollers 57, 58. Spindle 21 is the front portion of shaft 44 and extends forward from arm 41 near its radially outer end, being perpendicular thereto and parallel to carrier shaft 19. Follower rollers 57, 58 are at the rear of arm 41, being rotatably mounted on stub shaft 61 that projects from aperture 59 which extends through arm 41 radially inward of shaft 44. Closed loop cam track 55 surrounds mandrel disc drive shaft 19 and receives followers 57, 58. In a manner known to the art, cooperation of cam 55 and followers 57, 58 controls the radial spacings between the respective rotational axes 80, 85 defined by shaft 19 and spindles 21, respectively.

With particular reference to FIGS. 8–11 it is seen that support arm 41 is an elongated member that is tapered lengthwise, being widest at its radially outer end where stub shaft 44 and cam follower rollers 57,. 58 are mounted. Aperture 71 in arm 41 is disposed radially outward of aperture 59 and is provided to receive mounting section 22 (FIG. 12) at the rear end of shaft 44. The outer cylindrical surface 72 of shaft 44 to the rear of axle shoulder 73 is closely fitted to the inner cylindrical surface of aperture 71. As will hereinafter be explained, shaft 44 is pivotable relative to arm 41 about the axis 74 about which surface 72 is formed.

Pressurized air and vacuum are selectively supplied to aperture 71 through L-shaped passage 81 whose outer end is connected through rigid stub pipes 82*a*, 82*b*to fitting 82 (FIG. 2) at one end of flexible hose 83. The inner end of passage 81 communicates with circular undercut 86 in mounting surface 72 of shaft 44 and transverse passages 87, 87 connect undercut 86 with passage 148 that extends axially through shaft 44 so that pressurized air and vacuum can be present at the forward end of spindle 21. The end of hose 83 remote from fitting 82 is provided with fitting 84 that is connected through rigid stub pipe 85*a*to supply passage 85 which extends through movable face valve member 75 that is connected to hub 47 for continuous rotation therewith.

Each airway between a passage 85*a*and the outer end of a passage 81 consists of flexible hose 83 and rigid stub pipes 82*a*, 82*b*, 85*a*. As seen in FIG. 2, the vast majority of the length of hose 83 is bent to form a single loop with very short portions of hose 83 being required to connect such single loop to pipes 85*a*and 82*a*, 82*b*. Further, the hose 83 is positioned so that no side portions thereof do not rub against other side portions thereof or rub against other elements of the apparatus. Hose life is shortened very quickly in the event hose 83 rubs against another element or portions of the hose rub against each other.

At its rear end 88*a*, longitudinal passage 148 is enlarged and is provided with an internal thread that is engaged by retainer 188 which draws shoulder 73 against the front end of arm 41 to secure axle 44 to arm 41. At its front end 88*b*, longitudinal passage 148 is threaded internally to receive a screw (not shown) that retains mandrel 20 mounted on spindle shaft 21.

Threaded apertures 78, 79 extend outward from aperture 71 and are positioned so that adjusting screws 76, 77 which extend through respective apertures 78, 79 are accessible for operation from outside of arm 41 to adjust the angular position of axle 44. That is, when screws 76, 77 move inward through apertures 78, 79 the inner ends of screws 76, 77 engage respective ledges 88, 89 in surface 72. To pivot axle 44, say clockwise when looking at its front or spindle end, screw 76 must be backed away from ledge 88 and then screw 77 is turned inward against ledge 89 until axle 44 reaches a desired angular position by turning clockwise about mounting axes 74. The latter is parallel to but slightly eccentric with respect to spindle axis 85 so that as axle 44 pivots the spacing between spindle axis 85*a*nd axis 80 of mandrel carrier 18 changes. After the desired spacing between axes 80 and 85 is reached, screw 76 is turned inward against ledge 88 to lock axle 44 against pivoting about-mounting axis 74. To pivot axle 44 counterclockwise, screw 77 is backed away from ledge 89, then screw 76 is turned inward against ledge 88 to pivot axle 44 counterclockwise until spindle 21 reaches its required position, and then screw 77 is moved forward against ledge 79 to lock axle 44 against pivoting.

Now referring more particularly to FIGS. 5–8, carrier 18 is a steel disc that carries twenty-four (24) mandrel subassemblies 40 that are in a generally circular array about carrier axis 80 as a center. The major portion of each subassembly is arranged to reciprocate radially with respect to axis 80, being guided by the cooperation of mono rail 51 and a pair of aligned cylindrical roller-type bearing units or linear slides 90, 90 through which rail 51 extends. A suitable mono rail structure for the decorating apparatus of the instant invention is marketed by Schneeberger Inc., having a place of business located in Bedford, Mass. 01730 U.S.A.

Rail 51 (FIGS. 16 and 17) of such mono rail structure is an elongated member which includes rear wall 91 and short parallel sidewall sections 92, 92 extending forward from opposite ends of rear wall 91. Located at each side of rail 51 and extending forward from each wall section 92 are a pair of flat longitudinal guide surfaces 93, 93. Bearing elements 95 of two slide units 90 ride on each surface 93. The pair of guide surfaces 93, 93 on the right of FIG. 16 are at right angles to each other and the rear one of this pair is at 45° with respect to right wall section 92. Similarly, the pair of guide surfaces 93, 93 on the left in FIG. 16 are mirror images of the other pair 93, 93. Thus, slide units 90, 90 lock rail 51 from pivoting clockwise or counterclockwise about the longitudinal axis of rail 51. Each linear slide 90 includes four arrays 94 of bearing elements 95, one for each rail surface 93, with each bearing array being disposed to move along an individual raceway (not shown) which is formed in housing 180 of slide unit 90 so that, as seen in FIG. 17, a portion of each array is exposed to engage a rail surface 93.

Unless precautions are taken to restrain bearing elements 95, one or more of them can separate easily from base 180 and compromise the integrity of assembly between rail 51 and bearing units 90, 90. Thus, retainer 201 (FIG. 8) is removably secured to the radially inner end of arm 41 to prevent separation between rail 51 of subassembly 40 and slides 90, 90. That is, there will be interference between slides 90, 90 and retainer 201 so long as screw 202 secures retainer 201 in its operative position at the radially inner end of rail 51. The enlarged radially outer end of arm 41 blocks removal of slides 90, 90 at the radially outer end of rail 51.

Positional integrity of rail 51 relative to arm 41 is achieved by fastening screws 96 that extend through individual clearance apertures 103 in rail 51 and are received by individual threaded apertures 104 in arm 41. Arm 41 also includes shallow longitudinal channel 102 (FIG. 11) defined by a pair of short parallel arms 101, 101 at the front of arm 41. The short sidewalls 92, 92 of rail 51 enter channel 102 and are fitted tightly between arms 101, 101 which block guide rail 51 from movement about axes that extend at right angles to rear wall 91.

Positional integrity of subassembly 40 is controlled to a great extent by rigidly positioning slide units 90, 90 on carrier 18. More particularly, carrier 18 (FIGS. 4–7) is a steel disk having flat front surface 128 and rear surface 129 that is machined to form an individual shallow radial groove 125 for the pair of slides 90, 90 that guides each of the subassemblies 40. For each groove 125, carrier 18 is provided with eight clearance apertures 126 that are aligned with the respective threaded apertures 136 at the front of slides 90, 90 to threadably receive fastening screws (not shown) that extend through apertures 126. For each groove 125, carrier 18 is also provided with a pair of clearance apertures 127 that are aligned with respective openings 137 at the front of slides 90, 90. Lubricant applied through apertures 127 to openings 137 lubricates the elongated bearing elements 140 of slides 90, 90. Threaded mounting apertures 136 are in front wall 151 of slide 90, which wall 151 is drawn against the bottom wall 152 of groove 125 and short side walls 153, 153 of groove 125 are fitted tightly against slide 90 with screws 203.

Application of pressurized air and vacuum to hoses 83 is under the control of a face-valve arrangement that includes stationary valve elements 199 mounted at the front of stationary frame member 99 and rotating wear plate 198 having apertures aligned with one end of channels 85 in hub attachment 75.

Each of the four longitudinal bearing faces 93 of rail 51 is in sliding engagement with an individual partial array of bearing elements 95 of two slides 90, 90, so that rail 51 is constrained to reciprocate radially. Each of the bearing elements 95 is cylindrical with a length transverse to bearing face 93, that is greater than the diameter of the elements 95. The cylindrical surfaces of elements 95 are parallel to each other and extend crosswise with respect to the length of bearing faces 93 which they engage.

For each slide 90, each of the four bearing element arrays occupies an individual raceway 191 in the housing 180 of slide 90. The bearing elements 95 of the partial array are disposed with their cylindrical axes in a plane that is parallel to the bearing face 93 with which the partial array is engaged.

Although the present invention has been described in relation to particular embodiments thereof, many other variations and modifications and other uses will become apparent to those skilled in the art.

What is claimed is:

1. Continuous motion apparatus for decorating cylindrical containers, said apparatus comprising a decorating section and a transport section that carries containers through a decorating zone where decorations are applied to the containers, said transport section including:

a carrier continuously rotating on a carrier axis, said carrier having a front facing side, a plurality of mandrel subassemblies mounted on said carrier with equal angular spacings between adjacent ones of said subassemblies, each of said subassemblies being mounted to reciprocate along an individual path that is disposed radially relative to said carrier axis as a center;

each of said subassemblies including an elongated support arm extending lengthwise of an individual one of said paths, an axle extending forward from said arm and being generally parallel to said carrier axis, and a rail secured to said arm and extending lengthwise thereof;

said axle including a spindle section for supporting a rotatable mandrel that carries containers through said decorating zone, said axle also including a mounting section rearward of said spindle section, said mounting section being connected to said arm at a radially outer end of said arm;

for each of said subassemblies, at least one slide unit secured to said front facing side of said carrier and being operatively engaged with said rail to slidably support said subassembly as it reciprocates radially;

each of said rails having at least two bearing surfaces each of which is engaged by a different group of bearing elements of said at least one slide unit.

2. Apparatus for decorating cylindrical containers as defined by claim 1 in which said bearing elements extend crosswise of said path.

3. Apparatus for decorating cylindrical containers as defined by claim 2 in which each of said bearing elements is cylindrical with a length to diameter ratio which is substantially greater than one.

4. Apparatus for decorating cylindrical containers as defined by claim 1 in which each of said arms is provided with a shallow longitudinally extending groove that is defined by a pair of spaced parallel groove walls that are tightly fitted against opposite side portions of said rail that is entered into said groove.

5. Apparatus for decorating cylinder containers defined claim 1, further comprising an individual airway for each of said mandrel subassemblies through which vacuum and pressurized air is supplied selectively to said mandrel, the vacuum acting to hold a can loaded on said mandrel and the pressurized air acting to unload a can from said mandrel;

said airway extending between said support arm and said carrier, and including a flexible section having a length whose vast majority is curved into a single loop.

6. Apparatus for decorating cylindrical containers as defined by claim 5 in which said airway, except for said flexible section, is rigid.

7. Apparatus for decorating cylindrical containers as defined by claim 5 in which one end of said loop coincides essentially with one end of said flexible section and at the other end of said flexible section extends beyond said loop.

8. Apparatus for decorating cylindrical containers as defined by claim 7 in which said one end of said flexible section is connected to said carrier and is radially inboard of said other end of said flexible section.

9. Apparatus for decorating cylindrical containers as defined by claim 1, further comprising each of said subassemblies including a removable retainer to maintain engagement between said rail and said at least one slide unit when said at least one slide unit is dismounted from said carrier.

10. Apparatus for decorating cylindrical containers as defined by claim 9 in which said retainer is mountable on said support arm at its radially inner end.

11. Continuous motion apparatus for decorating cylindrical containers, said apparatus comprising a decorating section and a transport section that carries containers through a decorating zone where decorations are applied to the containers, said transport section including:

a carrier continuously rotating on a carrier axis, said carrier having a front facing side, a plurality of mandrel subassemblies mounted on said carrier with equal angular spacings between adjacent ones of said subassemblies, each of said subassemblies being mounted to reciprocate along an individual path that is disposed radially relative to said carrier axis as a center;

each of said subassemblies including an elongated support arm extending lengthwise of an individual one of said paths, an axle extending forward from said arm and being generally parallel to said carrier axis, and a rail secured to said arm and extending lengthwise thereof;

said axle including a spindle section for supporting a rotatable mandrel that carries containers through said decorating zone, said axle also including a mounting section rearward of said spindle section, said mounting section being connected to said arm at a radially outer end of said arm;

for each of said subassemblies, at least one slide unit secured to said front facing side of said carrier and being operatively engaged with said rail to slidably support said subassembly as it reciprocates radially;

each of said rails having at least one bearing surface which is engaged by bearing elements of said at least one slide unit;

said rear mounting section having a cylindrical outer surface and being disposed within a recess of said arm, said recess having a cylindrical inner surface that is closely fitted to said outer surface, with said inner and outer surfaces having a common mounting axis about which said axle is pivotable to operatively position said spindle relative to said carrier axis in that said spindle is provided with a longitudinal axis that is parallel to said mounting axis and is eccentric with respect thereto and elements connected with said spindle for adjusting the rotation orientation of said axle to move said spindle axis to adjust the printing pressure on a container on the respective said mandrel.

12. Apparatus for decorating cylindrical containers as defined by claim 11 also including first and second adjusting screws for each of subassemblies, said screws threadably mounted to said arm with each of said screws having an outer end that is engageable from outside of said arm and an inner end that extends into said recess to engage an individual ledge cut in said outer surface of said mounting section;

said inner ends of the respective first and second screws engaging a respective first and second of said ledges which are positioned so that with said second screw withdrawn from said second ledge, turning of said first screw inward while engaged with said first ledge pivots said axle in a first direction about said mounting axis, and with said first screw withdrawn from said first ledge, turning of said second screw inward while engaged with said second ledge pivots said axle in a second direction about said mounting axis, with said second direction being opposite to said first direction.

13. Apparatus for decorating cylindrical containers as defined by claim 12 in which:

after inward turning of said first screw to pivot said axle to a first angular position, inward turning of said second screw into engagement with said second ledge locks said axle in said first angular position; and after inward turning of said second screw to pivot said axle to a second angular position, inward turning of said first screw into engagement with said first ledge locks said axle in said second angular position.

14. Apparatus for decorating cylindrical containers as defined by claim 4 in which each of said arms is provided with a shallow longitudinally extending groove that is defined by a pair of spaced parallel groove walls that are tightly fitted against opposite side portions of said rail that is entered into said groove.

* * * * *